US007703630B2

(12) United States Patent
Degutis et al.

(10) Patent No.: US 7,703,630 B2
(45) Date of Patent: Apr. 27, 2010

(54) VENTED HATCH COVER

(75) Inventors: Alex V. Degutis, East Chicago, IN (US); Michael S. Ryan, Darien, IL (US); Peter Gubricky, Crest Hill, IL (US)

(73) Assignee: Saldo Products Inc., Lemont, IL (US)

( * ) Notice: Subject to any disclaimer, the term of this patent is extended or adjusted under 35 U.S.C. 154(b) by 618 days.

(21) Appl. No.: 11/610,421

(22) Filed: Dec. 13, 2006

(65) Prior Publication Data

US 2008/0146136 A1 Jun. 19, 2008

(51) Int. Cl.
*B65D 51/16* (2006.01)
*B65D 53/00* (2006.01)

(52) U.S. Cl. ..... 220/371; 220/372; 220/378

(58) Field of Classification Search ..... 220/326, 220/371, 372, 378, 787, 788, 799, 800, 849; 454/83; 105/377.07
See application file for complete search history.

(56) References Cited

U.S. PATENT DOCUMENTS 4,819,830 A 4/1989 Schultz
5,064,089 A 11/1991 Schultz
5,622,117 A * 4/1997 Burian et al. ..... 105/377.07
5,960,980 A * 10/1999 Burke et al. ..... 220/325
6,050,199 A * 4/2000 Anderson et al. ..... 105/377.07
2004/0256269 A1* 12/2004 Gleichauf et al. ..... 206/439
2008/0146136 A1 6/2008 Degutis et al.

* cited by examiner

*Primary Examiner*—Anthony Stashick
*Assistant Examiner*—Madison L Wright
(74) *Attorney, Agent, or Firm*—Leydig, Voit & Mayer Ltd.

(57) ABSTRACT

A vented hatch cover comprising a cover body, an intake filter element, and a discharge filter element includes a plurality of walls defining an air intake passage, and an air discharge passage, an inner rim and an outer rim with a plurality of ribs extending across the air intake passage. The intake filter element includes a plurality of latches engaging the ribs. The discharge filter element includes an outer disc portion with a radially outer edge having a rim with a plurality of latches that releasably secure the discharge filter element to the inner rim of the cover body.

40 Claims, 7 Drawing Sheets

VENTED HATCH COVER

BACKGROUND OF THE INVENTION

The present invention relates to a vented hatch cover for railroad cars. More specifically, it relates to a vented hatch cover for railroad cars having air filtering mechanisms.

Railroad hopper cars carrying bulk particulate matter, such as grain or plastic pellets, are typically unloaded by applying a vacuum conveying line to an outlet gate positioned at the bottom of each car compartment. The primary air flow for the vacuum conveying line is obtained from the exterior of the car. However, the rate of content removal results in reduction in pressure above the lading. The top of the car compartment must be vented to compensate for material drawn out the bottom of the compartment. Failure to vent the top of the compartment would reduce the efficiency of the vacuum unloading process and even risk damage to the car structure.

Vented hatch covers are known. They represent a successful solution to the prior deficiencies. Such covers are available from Salco Products Inc., Lemont, Ill. The vented hatch covers successfully marketed by Salco Products have downwardly or inwardly directed vent openings which are protected from the elements. These configurations are disclosed in U.S. Pat. Nos. 4,819,830; 5,064,089 and 5,622,177, the disclosures of which are incorporated herein by reference. The present invention represents a refinement in the vented hatch covers of the type in U.S. Pat. Nos. 4,819,830; 4,964,089 and 5,622,177. The vented hatch cover of the present invention provides the benefits of easy and quick installation and removal of the intake and discharge filter elements. The vented hatch cover of the present invention further provides the benefit of added rigidity to the walls defining the intake passage to prevent the walls from collapsing toward each other or expanding away from each other. This added rigidity to the walls ensures that the air intake passage maintain the full open area.

DETAIL DESCRIPTION OF THE ILLUSTRATED EMBODIMENT

Figure 1:
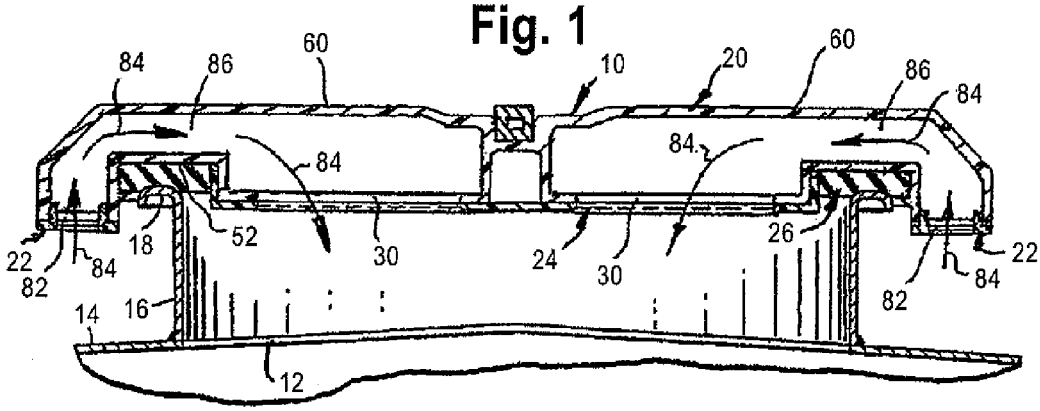
FIG. 1 is a sectional view of a vented hatch cover according to the present invention secured to a hatch opening.
Figure 2:
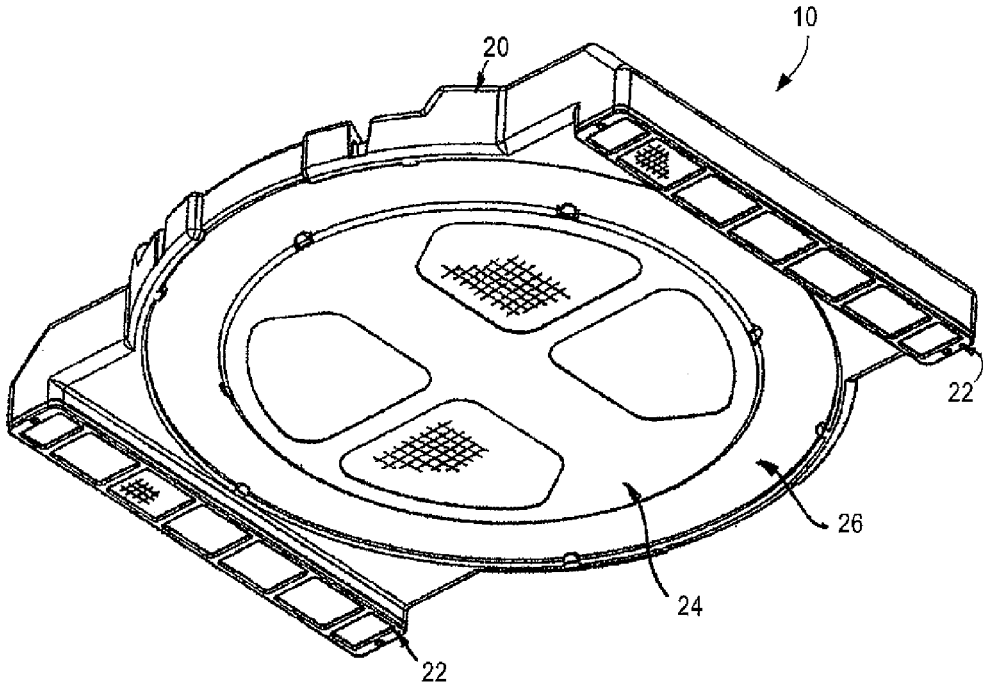
FIG. 2 is a perspective bottom view of the vented hatch of FIG. 1.

FIG. 1 illustrates the hatch cover assembly 10 of the present invention in association with a hatch opening or passage 12 in the roof or top 14 of an enclosed or covered railroad hopper car. Hatch opening 12 is defined by an annular ring like coaming 16. The hatch coaming 16 surrounds the opening 12. In this illustration, the top edge of the coaming 16 has a turned-over flange 18. Not all hatch coamings include such a flange.

The hatch cover assembly 10 is comprised of a cover body 20, two side or intake filter elements 22, an interior or discharge filter element 24 and a gasket 26 adapted to engage the coaming 16 to seal the opening 12. With the cover assembly 10 in place on the coaming 16 of a railroad car, air in the atmosphere is free to enter the car. It enters the cover assembly through air intake passages.

Figure 4:
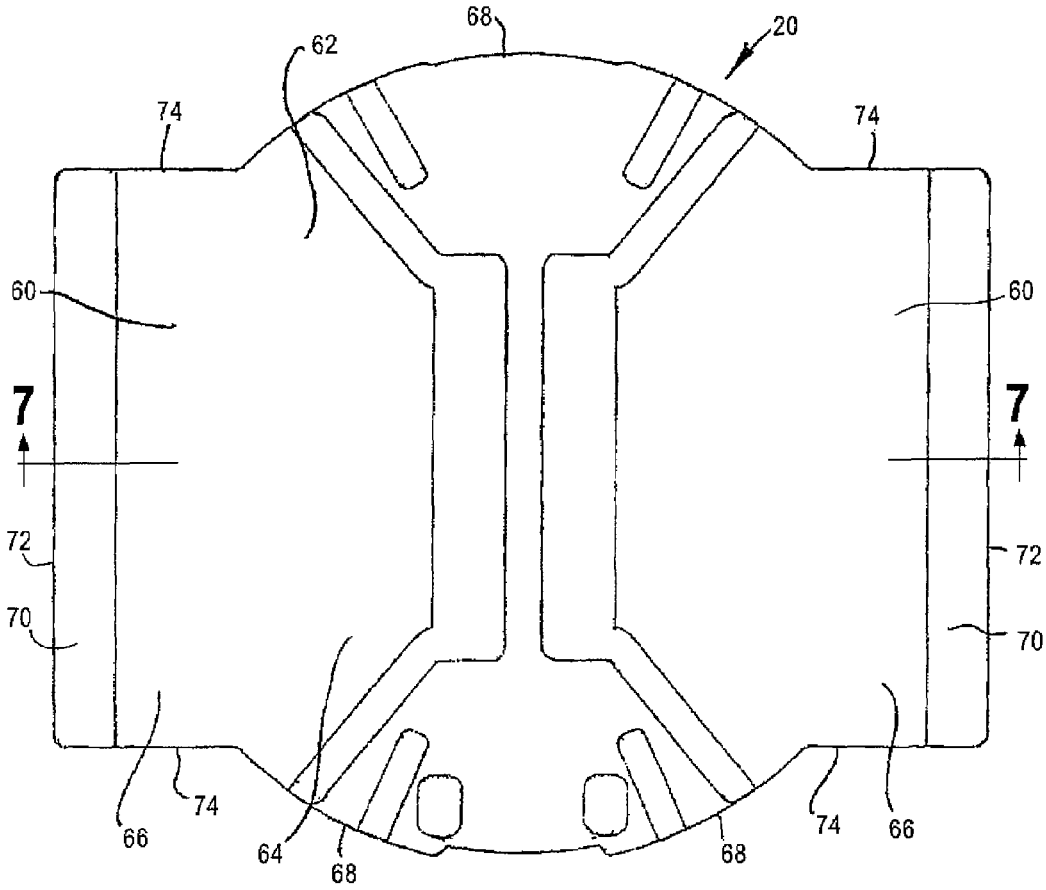
FIG. 4 is a top view of a cover body of the vented hatch cover of FIG. 1.
Figure 5:
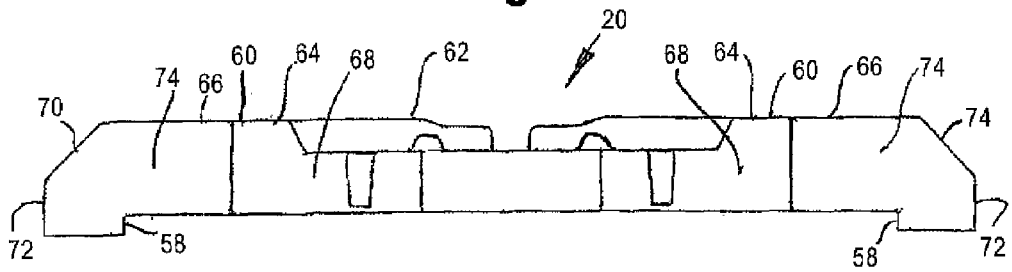
FIG. 5 is a side view of the cover body of FIG. 4.
Figure 6:
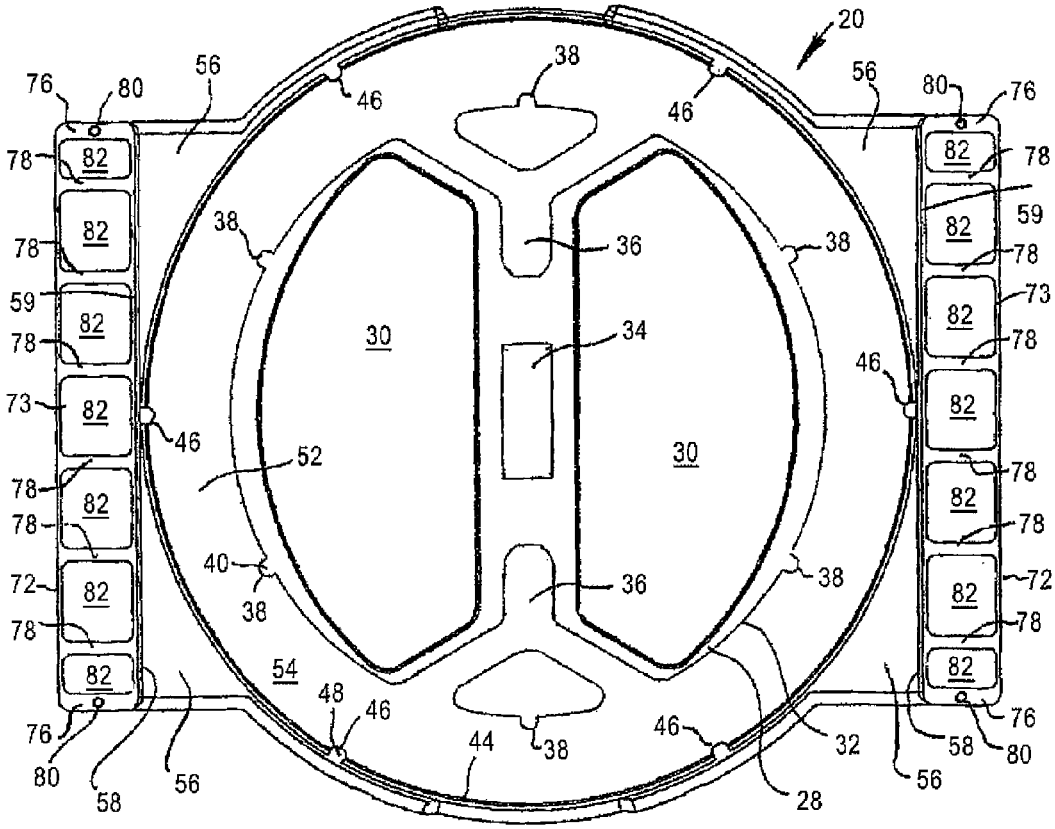
FIG. 6 is a bottom view of the cover body of FIG. 4.
Figure 7:
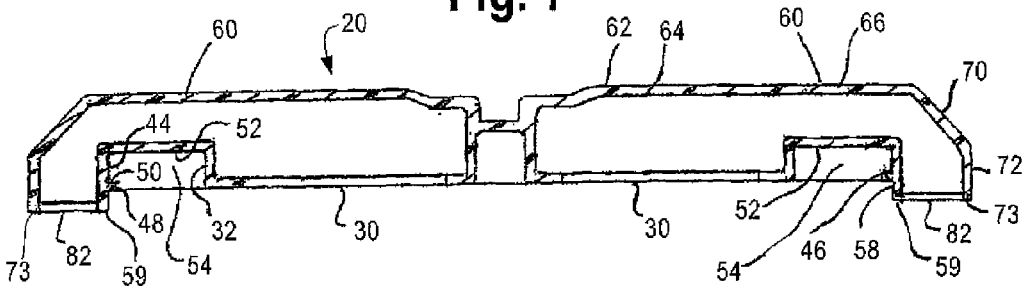
FIG. 7 is a sectional side view of the cover body of FIG. 4, as taken along line 7-7 of FIG. 4.
Figure 8:
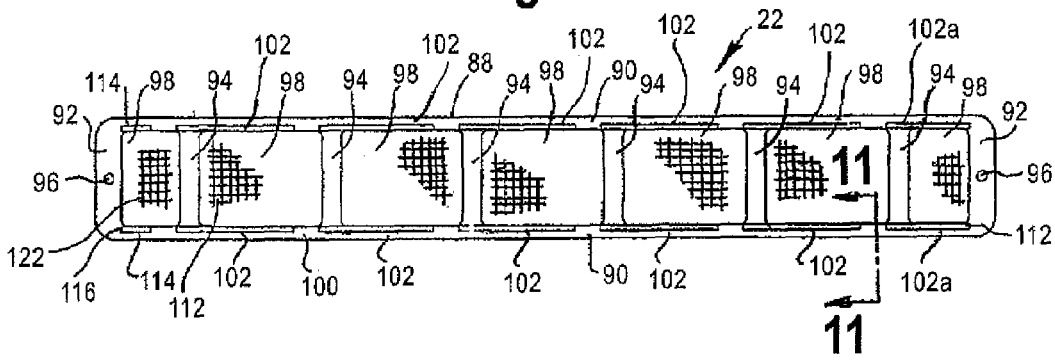
FIG. 8 is a top view of an intake filter element of the vented hatch cover of FIG. 1.
Figure 9:
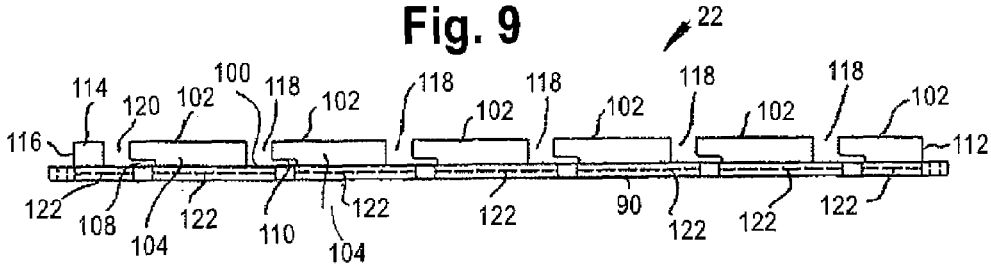
FIG. 9 is a side view of the intake filter element of FIG. 8.
Figure 10:
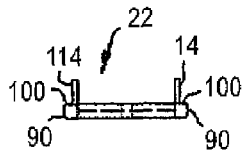
FIG. 10 is an end view of the intake filter element of FIG. 8.
Figure 11:
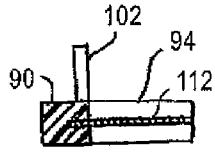
FIG. 11 is a sectional view of the intake filter element of FIG. 8, as taken along line 11-11 of FIG. 8.

The cover body 20 is illustrated in detail in FIGS. 4-7. The cover body 20 includes a base 28 and a shell 62. Together, they form duel hoods defining a pair of air discharge passages 30, as shown in FIGS. 6-7, and disclosed in U.S. Pat. No. 5,064,089. The base 28 is generally circular shaped with the circumferentially outer edges defining a circular inner rim 32. The base 28 includes a central rib 34 and two Y-shaped ribs 36 extending upward from the bottom of the base 28 to add rigidity to the cover body 20. It should be noted that the terms "upward" and "downward" are used herein to refer to the direction as the hatch cover assembly normally resides in a closed position on top of an upright railroad hopper car.

Figure 3:
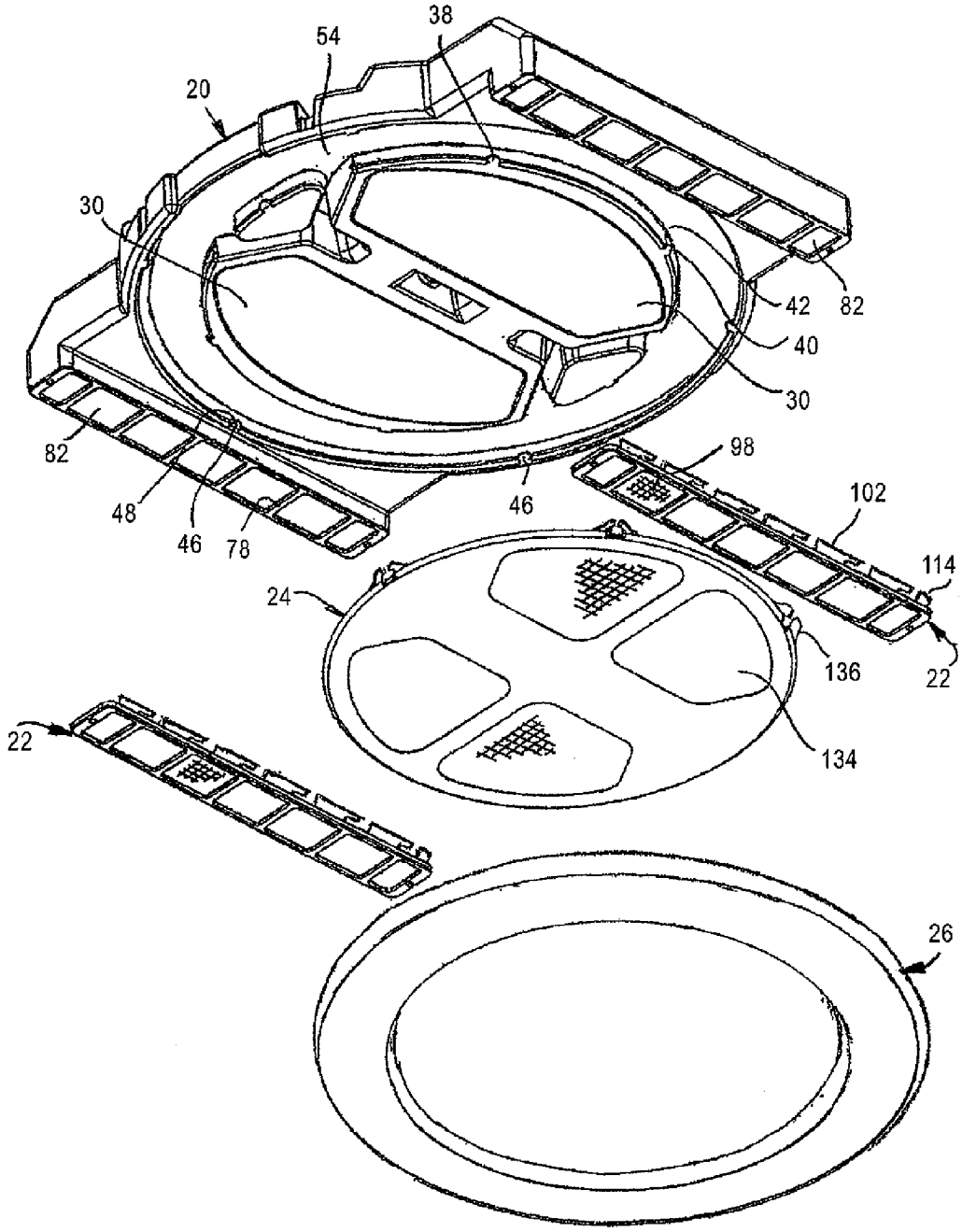
FIG. 3 is an exploded perspective bottom view of the vented hatch cover of FIG. 17 prior to assembling the vented hatch cover components.

Six approximately equally spaced inner clips 38 extend radially outward from the inner rim 32. Each inner clip 38 has a ramped surface 40 facing downward and radially outward. Each inner clip 38 also has a ledge 42 facing upward, as shown in FIG. 3. The inner clips 38 all have approximately the same height and approximately the same width. The cover body 20 further includes a circular outer rim 44 located radially outward a distance from the inner rim 32. Six approximately equally spaced outer clips 46 extend radially inward from the outer rim 44. Each outer clip 46 has a ramped surface 48 facing downward and radially inward. Each outer clip 46 also has a ledge 50 facing upward, as shown in FIG. 7. The outer clips 46 all have approximately the same height and approximately the same width. Preferably the inner clips 38 and the outer clips 46 are staggered as shown in FIG. 6, although aligned clips could also be used.

A ring-shaped or annular seat 52 connects the outer rim 44 to the inner rim 32. It is intended to overlie the top of the turned-over flange 18 of the coaming 16, when the hatch cover assembly 10 is positioned on the coaming in the closed position as shown in FIG. 1. The seat 52 is located above the lowermost edges of the inner and outer rims 32 and 44. The seat 52, along the with inner and outer rims 32 and 44 define an annular pocket 54 for receiving the gasket 26.

As shown in FIG. 6, two approximately circumferentially spaced bottom walls 56 extend radially outward from the bottom edge of the outer rim 44 and terminate at a hood inner wall 58. The hood inner wall 58 extends downward from the bottom wall 56 with the lowermost edge 59 of the hood inner wall 58 located below the inner and outer rims 32 and 44, as shown in FIG. 7.

The shell 62 includes two hoods 60, defining the double vents, and a generally circular portion 64. Each hood 60 has a extension portions 66 extending radially outward from the generally circular portion 64, beyond the outer rim 44 of the cover body 20, as shown in FIGS. 4-5. Each extension portion 66 terminates at a downward sloped wall 70 which connects the extension portion 66 with a hood outer wall 72. The lowermost edge 73 of the hood outer wall 72 extends below the inner and outer rims 32 and 44. Two flat hood side walls 74 connect the extension portion 66 of the shell 62, the sloped wall 70, and the hood outer wall 72 to the bottom wall 56 and the hood inner wall 58. The extension portion 66, the hood outward wall 72, the two hood side walls 74, the bottom wall 56 and the hood inner wall 58 form one of the hoods 60. Another set of extension portion 66, hood outer wall 72, two hood side walls 74, bottom wall 56 and hood inner wall 58 at the other side of the shell 62 form the other hood 60 of the double vents. Two curved side walls 68 extend from the generally circular portion 64 and merge with the outer rim 44.

The hood outer wall 72, the hood inner wall 58 and the two hood side walls 74 define an air intake passage 82. Air flow from the air intake passage 82 to the air discharge passage 30 is indicated by arrows 84 in FIG. 1. Air enters each hood 60 of the cover body 20 through the air intake passages 82. The air then flows through into a plenum section 86 and exits the cover body 20 through the air discharge passage 30. A similar air flow occurs through the other hood 60 of the cover body 20.

As shown in FIG. 6, two end ribs 76 and six intermediate ribs 78 connect each hood outer wall 72 to the hood inner wall 58. The intermediate ribs 78 extends across the air intake passage 82 of the hood 60. Each end rib 76 defines a pin hole 80. The ribs 76 and 78 provide rigidity to the hood outer wall 72 and hood inner wall 58 to prevent the walls 72 and 58 from collapsing toward each other or expanding away from each other This added rigidity to the walls 72 and 58 ensures that the air intake passage 82 maintain the full open area.

It will be noted that the construction of the walls direct the air intake passages 82 in a downward direction, when the hatch cover assembly 10 is in the closed position. This construction provides efficient air exchange while presenting an air flow path that reduces entrance of contaminants from the exterior of the hatch cover assembly 10. The air intake passages 82 are radially outboard of the coaming 16 and the air flow through each air passage is sufficiently circuitous that droplets of water, snow or other contaminants are unlikely to be carried into and through the air passages.

While the cover body 20 is described as having a plurality of separate walls and ribs, the cover body is preferably formed as a single part, such as by blow molding with the walls integral to formed a weather tight enclosure.

A ring-shaped gasket 26 of suitable material is fitted within the pocket 54 defined by the inner rim 32, the outer rim 44 and the seat 52. The gasket 26 contacts the flange 18, when the hatch cover assembly 10 is in the closed position, to provide a weather tight engagement. In instances where no flange is present, the gasket 26 would contact the top of a ring shaped coaming 16.

FIGS. 8-11 illustrate in detail the side or intake filter element 22. The intake filter element 22 is slidably and removably secured to the cover body 20. It prevents, or greatly reduces, outside contaminates from entering the cover body 20. The intake filter element 22 is disposed over the air intake passages 82 of one of the hoods 60, such that the intake filter element 22 is in the flow path of the air entering the air intake passages 82.

The intake filter element 22 has a frame 88. The frame 88 includes two longitudinal beam portions 90. The frame 88 also includes two end cross beam portions 92 and six intermediate cross beam portions 94 connecting the two longitudinal beam portions 90. Each end cross beam portion 92 defines a pin hole 96. The total number of cross beam portions 92 and 94 is preferably the same as the number of ribs 76 and 78 of one of the hoods 60. The frame 88 defines seven intake filter openings 98.

Extending upward from the top edge 100 of each longitudinal beam portion 90 are six latches 102 for engagement with the intermediate ribs 78 of the cover body 20. Latch **102*a* at one end of the intake filter element 22 is shorter than the other five latches. Preferably the number of latches 102 extending from each longitudinal beam portion 90 is the same as the number of intermediate ribs 78 extending across the air intake passage 82 of one of the hoods 60. Each latch 102 has a base 104 extending upward from a section of the longitudinal beam portion 90 in between two adjacent cross beam portions 92 and 94. Each latch 102 further includes a hook 106 extending laterally above one of the intermediate cross member 94. Each latch 102 defines a slot 108 in between the bottom edge 110 of the hook 106 and the top edge 100 of the longitudinal beam portion 90. The height of the slots 108 should be slightly greater than the thickness of the intermediate ribs 78 to allow the intermediate ribs 78 to slide into the respective slots 108. The shortened latch 102*a* has an abutment edge 112 for abutment with one of the end ribs 76 of the corresponding hood 60 once the intake filter element 22 has been slidably secured to the cover body 20. A stop 114 extends upward from the end of each longitudinal beam portion 90 opposite the shortened latch 102*a*. The stop 114 has a abutment edge 116 for abutment with the other end rib 76 of the corresponding hood 60 once the intake filter element 22 has been slidably secured to the cover body 20. The width of the gap 118 between adjacent latches 102 and the gap 120 between the stop 114 and its adjacent latch 102 should be greater than the width of the intermediate ribs 78. While the frame 88 of the intake filter element 22 is described as having separate beam portions and latches, each intake filter frame 22** is preferable formed as a single piece, such as by injection molding, with the beam portions and latches integral.

Each intake filter element 22 also has a filter material 122 over-molded by the frame 88 and occupying the intake filter opening 98. The filter material 122 of the intake filter element 22 may be any suitable filter media, such as reticulated polyurethane foam or woven nylon screen. The frame 88 may be molded over the filter material 122 by injection molding the frame 88 around the filter material held in place by clips during the molding process. Alternatively, the frame 88 may be molded over the filter material 122 by sandwiching the filter material 122 between two sections of an injection molding die and then injection molding the frame 88 in the die.

Figure 12:
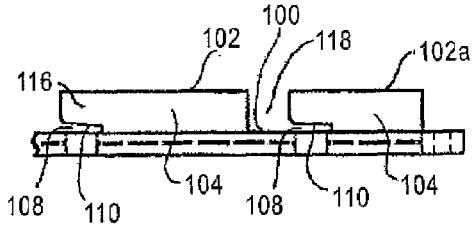
FIG. 12 is an enlarged side view an alternative latch of an intake filter element according to the present invention for securing the intake filter element to the cover body.

FIG. 12 illustrates an alternative latch 102 of an intake filter element according to the present invention for securing the intake filter element to the cover body. The alternative latch 102 includes a slot 108 tapered from the gap 118 to the base 104 of the latch. In order to define a tapered slot 108, the bottom edge 110 of the hook 106 is angled downward from the free end of the hook 106, defining the gap 118, to the base 104 of the latch. The height of the tapered slot 108 is shortest near the base 104, with the shortest height of the tapered slot 108 approximately the same or slightly smaller than the thickness of the intermediate ribs 78. The shape and variable height of the tapered slot 108 of the latch 102 pulls the longitudinal beam portion 90 of the frame 88 upward as the intermediate rib 78 slides into the tapered slot 108, assuring that the top surfaces 100 of the longitudinal beam portions 90 are in contact with the lowermost edges 59 and 73 of the hood inner wall 58 and the hood outer wall 72.

Figure 13:
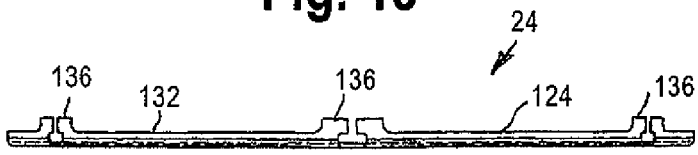
FIG. 13 is a side view of a discharge filter element of the vented hatch cover of FIG. 1.
Figure 14:
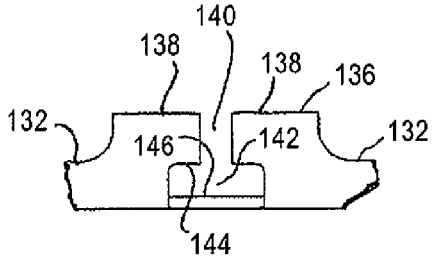
FIG. 14 is an enlarged side view of the latch of FIG. 12 for securing the discharge filter element to the cover body.
Figure 15:
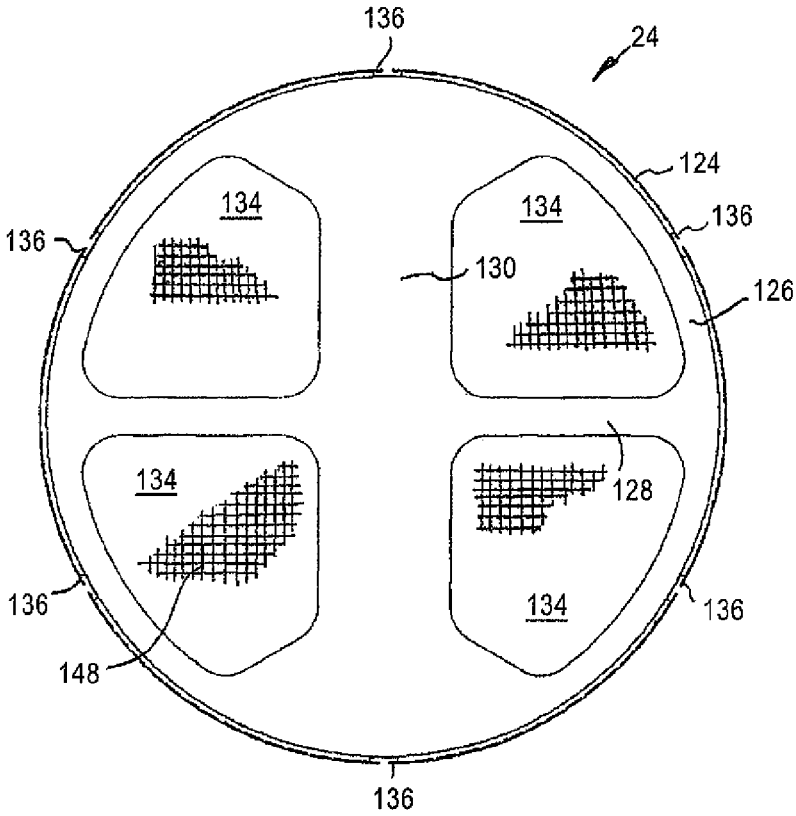
FIG. 15 is a bottom view of the discharge filter element of FIG. 14.

FIGS. 13-15 illustrate in detail the interior or discharge filter element 24. The interior or discharge filter element 24 is removably secured to the cover body 20. It prevents, or greatly reduces, lading from the interior of the car from being entrapped in the underside of the hatch cover assembly 10, from whence subsequence dislodgement could contaminate lading of a different character. The discharge filter element 24 is disposed over the air discharge passages 30, such that the discharge filter element 24 is in the flow path of the air exiting the air discharge passages 30. The discharge filter element 24 has a frame 124. The frame 124 includes an outer annular disk portion 126, a narrow beam portion 128 and a broad beam portion 130 connected to the radially inner edge of the disk portion 126. The narrow beam portion 128 and the broad beam portion 130 intersect to form a cross. A rim 132 extends upward from the radially outer edge of the disk portion 126. Four pie shaped discharge filter openings 134 are defined in the frame 124.

Six approximately equally spaced upward extending portions or latches 136 extend upward from the rim 132. One of the latches 136 is shown in the exploded view of FIG. 14. Each latch 136 includes two fingers 138 directed toward each other and a narrow gap 140 defined in between the fingers 138. The gap 140 has a width narrower than the width of the inner clip 38 of the cover body 20. The gap 140 extends downward into a slot 142 defined by the lower edges 144 of the fingers 138 and the upper surface 146 of annular disk portion 126. The slot 142 has a width greater than the width of the gap 140. The slot 142 has a height slightly larger than the height of the inner clip 38. The slot 142 has a width slightly larger than the width of the inner clip 38. The number of latches 136 is preferably the same as the number of inner clips 38. While the frame 124 of the discharge filter element 24 is described as having separate disk, beam portions and latches, the frame 124 is preferable formed as a single piece, such as by injection molding, with the disk, beam portions and latches integral.

The discharge filter element 24 also has a filter material 148 over-molded by the frame 124 and occupying the discharge filter openings 134. The filter material 148 for the discharge filter element 24 may be any form of suitable filter media, such as reticulated polyurethane foam or a woven nylon screen. The frame 124 can be molded over the filter material 148 by the same molding processes used to mold the frame 88 of the intake filter element 22 over the filter material 122, as previously discussed.

The assembly process of the hatch cover 10 will now be described. One of the intake filter element 22 is attached to one of the hoods 60 of the cover body 20 by first aligning the gaps 118 and 120 of the intake filter element 22 with corresponding intermediate ribs 78 extending across the air intake passage 82. Since the width of the gaps 118 and 120 is greater than the width of the intermediate ribs 78, the latches 102 and the stop 114 are able to fit between the intermediate ribs 78 without much effort when moving the intake filter element 22 upward towards the hood 60. The base 104 of the shortened latch 102*a* contacts an end rib 76 causing the longitudinal beam portions 90 to flex; thus allowing the intake filter element 22 to move closer towards the hood 60.

Once the top edges 100 of the longitudinal beam portions 90 are in contact with the intermediate ribs 78, assembly of the intake filter element 22 to the cover body 20 continues by sliding the intake filter element 22 longitudinally on the bottom surfaces of the intermediate ribs 78, along a plane defined by the bottom surfaces of the intermediate ribs, until the intermediate ribs 78 are situated in the slots 108 of the latches 102 and the abutment edge 116 of the stop 114 abuts one of the end ribs 76. At the same time, the base 104 of the shortened latch 102*b* surpasses the other end rib 76 and snaps into the portion of the air intake passage 82 defined between the end rib 76 and its adjacent intermediate rib 78. In this secured position, the intake filter element 22 is prevented from moving up and down relative to the cover body 20 by the abutting relationships of the intermediate ribs 78 with the hooks 106 at one surface and with the longitudinal beam portions 90 at the other surface. The intake filter element 22 is also prevented from moving longitudinally relative to the cover body 20 by the abutting relationship of the stop abutment edge 116 with one of the end rib 76 and the abutting relationship of the short latch abutment edge 112 with the other end rib 76. Rivets or screws (not shown) can also be inserted into the pin holes 96 of the intake filter element 22 and the corresponding pin holes 80 of the end rib 76 to further secure the intake filter element 22 to the cover body 20.

This arrangement of slidably mounting the intake filter element 22 to the cover body 20 allows for easy removal of the intake filter element 22 to clean or replace the intake filter element. To remove the intake filter element 22, one would simply need to remove the rivets or screws, if rivets or screws were used, spread the end of the intake filter element 22 downward from the end rib 76 of the hood 60 until the shortened latch 102*a* clears the end rib 76, and slide the intake filter element 22 longitudinally until the intermediate ribs 78 are in-line with the gaps 118 and 120 in between the latches 102. The intake filter element 22 can then be easily removed by pulling the intake filter element 22 downward away from the cover body 20.

Immediately below the air intake passage 82 are the openings 98 defined in the intake filter element 22, and likewise the filter material 122. Hence air flowing into each air intake passage 82 must pass through a filter material 122 to prevent or reduce the entry of contaminants. The other intake filter element 22 is attached to the other hood 60 in the same manner as described above.

In the secured position, each intermediate cross beam portion 94 of the intake filter element 22 is in contact with and located immediately below a corresponding intermediate rib 78 and each end cross beam portion 92 is in contact with and located immediately below a corresponding end rib 76. Also in the secured position, the top edges 100 of the longitudinal beam portions 90 are in contact with and located immediately below the lowermost edges 59 and 73 of the hood inner wall 58 and the hood outer wall 72. This arrangement maximizes the amount air capable of flowing into the air intake passages 82 by minimizing the additional obstruction created by the frame 88 of the intake filter element 22. This arrangement also forms a generally air tight seal between the intake filter element 22 and the cover body 20 so that air entering the air intake passage 82 must first flow through the intake filter material 122.

The discharge filter element 24 is removably secured to the cover body 20 by first aligning each latch 136 of the discharge filter element 24 with a corresponding inner clip 38. By pressing or pushing the discharge filter element 24 upward towards the base 28 of the cover body 20, the ramped surface 40 of each inner clip 38 contacts the fingers 138 of the corresponding latch 136 to spread the fingers 138 outwardly. Once the fingers 138 clear the ramped surface 40 of the inner clip 38, the fingers 138 snap back to its original position entrapping the inner clip 38 in the slot 142 of the latch 136. The abutting relationships of the ledges 42 of the inner clips 38 with the fingers 138 of the latches 136 secure the discharge filter element 24 to the cover body 20. With all six inner clips 38 situated in the slots 142 of the latches 136, the discharge filter element 24 is secured to the cover body 20. In the secured position; two of the openings 134 defined in the discharge filter element 24, and likewise the filter material 148, are located immediately below an air discharge passage 30. With the discharge filter element 24 secured to the cover body 20 in the illustrated manner, the discharge filter element 24 will remain with the cover body 20 even when the hatch cover 10 is opened. Whenever necessary, the discharge filter element 24 can be removed from the cover body 20 for cleaning and/or replacement by simply spreading the fingers 138 apart until they clear the inner clips 38 and then pulling the discharge filter element 24 downward away from the base 28 of cover body 20.

After the discharge filter element 24 has been secured to the cover body 20, the gasket 26 can be installed to cover body 20. The gasket 26 is installed by twisting it slightly in the vicinity of each clip 38 and 46, to slip the gasket 26 past the clips 38 and 46 and into the pocket 54. Once installed, the gasket 26 returns to its normal flat configuration and as such it will be retained in the pocket 54 by the ledges 42 and 50 of the inner and outer clips 38 and 46. Removal of the gasket 26 is accomplished by reversing the above described procedure.

Figure 16:
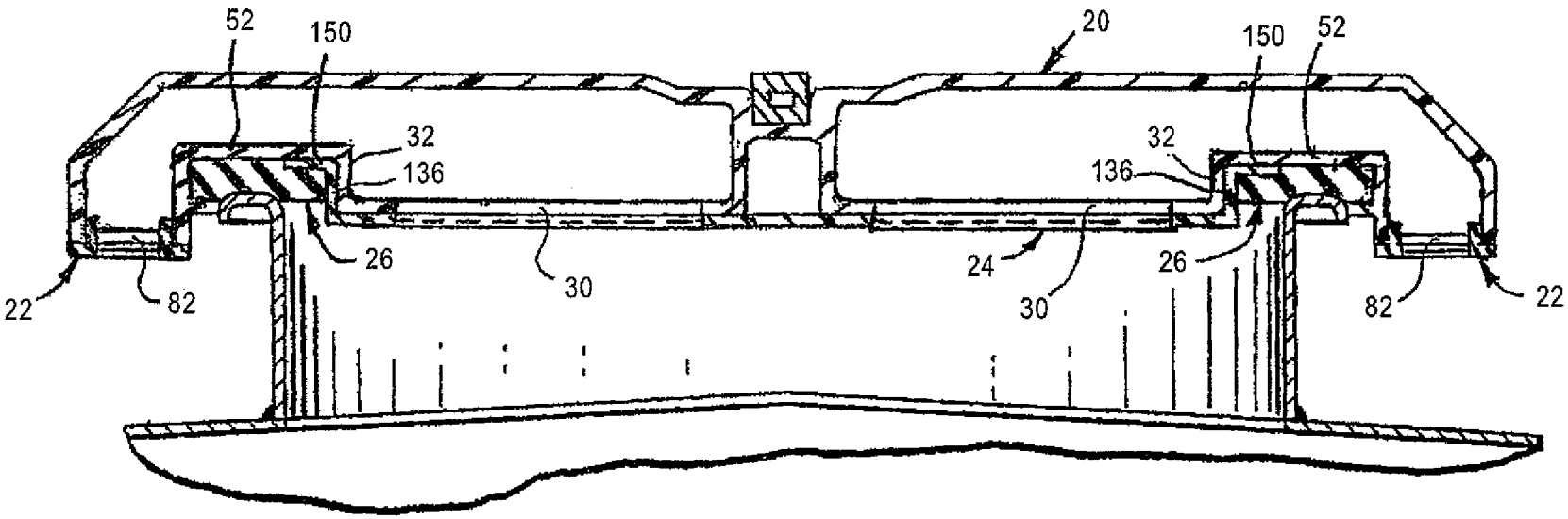
FIG. 16 is a sectional view of a vented hatch cover according to the present invention, showing an alternative latch for securing the discharge filter element to the cover body.

With the gasket retained in the pocket 54, the upward extending latches 136 of the discharge filter element 24 are located radially between and sandwiched by the radially inner surface of the gasket 26 and the radially outward surface of the inner rim 32. It should be noted that while the illustrated embodiment discloses the use of inner clips 38 to secure the discharge filter element 24 to the cover body 20, the discharge filter element 24 may also be secured to the cover body 20 merely by a friction fit between an upward extending portion or latch, such as or similar to the latches 136 previously disclosed, and the radially outward surface of the inner rim 32. The discharge filter element 24 may be also or further be secured to the cover body 20 by the interference created by the upward extending portion being sandwiched between the gasket 26 and the inner rim 32. Alternatively, the discharge filter element 24 may further include a radially extending portion or hook 150 extending from the free end of each upward extending portion 136, as illustrated in FIG. 16. The radially extending portions 150 are located above the top surface of gasket 26, between the gasket 26 and the seat 52. The abutting relationship of the radially extending portions 150 and the gasket 26 prevents the discharge filter element 24 from downward movement; thus, securing the discharge filter element 24 to the cover body 20.

The cover body 20, the intake filter frames 88, and the discharge filter screen frame 124 are preferably made from a polymeric material, such as a high impact, weatherable, ultraviolet resistant thermoplastic, including polypropylene, A.B.S., polycarbonate, rigid P.V.C., nylon, and polyester. Of course, aluminum or stainless steel or fiberglass could also be used. The gasket 26 may comprise any soft pliable material but is preferably made of a one-piece vinyl material.

While a preferred form of the invention has been shown and described, it will be understood that alterations to the illustrated embodiments could be made without departing from the scope of the following claims.

We claim:

1. A vented hatch cover comprising:

a cover body having a plurality of walls defining an air intake passage and an air discharge passage, said cover body includes an annular seat, an inner rim and an outer rim located radially outward of said inner rim, said annular seat, inner rim and said outer rim defining an annular pocket surrounding said air discharge passage;

a ring shaped gasket retained in said annular pocket of said cover body;

a discharge filter element disposed over said air discharge passage, said discharge filter element includes a frame including an outer disk portion having a radially outer edge, an upward extending rim extending from said radially outer edge and disposed radially between said inner rim and said gasket, said upward extending rim portion releasably engaged with said cover body to secure said discharge filter element to said cover body.

2. The vented hatch cover as claimed in claim 1 wherein said upwardly extending rim portion includes a plurality of latches including fingers having lower edges, said cover body further includes a plurality of clips extending radially outward from said inner rim, each having an upwardly facing ledge said upward facing ledges of said clips abutting said lower edges of said fingers of said latches, said clips and fingers releasably securing said discharge filter element to said cover body.

3. The vented hatch cover as claimed in claim 2 wherein said fingers of said latches of said upward extending rim portion of said discharge filter element define a gap having a width less than the width of said clips.

4. The vented hatch cover as claimed in claim 3 wherein said upward extending rim portion of said discharge filter element defines a slot, below each said gap, each said clip situated in one of said slots to secure said discharge filter element to said cover body.

5. The vented hatch cover as claimed in claim 1 wherein said cover body is adapted to overlie a coaming of a hatch opening nozzle.

6. The vented hatch cover as claimed in claim 5 wherein said pocket is aligned with the coaming when the vented hatch cover is in a closed position.

7. The vented hatch cover as claimed in claim 5 wherein said gasket engages the coaming when the vented hatch cover is in the closed position.

8. The vented hatch cover as claimed in claim 1 wherein said pocket is radially outward of said air discharge passage.

9. The vented hatch cover as claimed in claim 1 wherein said cover body further includes a plenum extending from said air intake passage to said air discharge passage.

10. The vented hatch cover as claimed in claim 1 wherein said cover body further includes a second set of clips extending inward from said outer rim, said second set of clips further releas ably retain said gasket to said cover body.

11. The vented hatch cover as claimed in claim 1 wherein the clips of said plurality of clips are approximately equally spaced.

12. The vented hatch cover as claimed in claim 10 wherein the clips of said second set of clips are approximately equally spaced.

13. The vented hatch cover as claimed in claim 1 further comprises an intake filter element disposed over said air intake passage.

14. The vented hatch cover as claimed in claim 13 wherein said intake filter element includes a plurality of latches engaging said cover body to secure said air intake filter element to said cover body.

15. The vented hatch cover as claimed in claim 14 wherein said cover body includes a plurality of ribs extending across said air intake passage, said latches of said intake filter element engage said ribs to secure said intake filter element to said cover body.

16. The vented hatch cover as claimed in claim 1 wherein said discharge filter element includes a filter material.

17. The vented hatch cover as claimed in claim 16 wherein said filter material is a woven screen.

18. The vented hatch cover as claimed in claim 16 wherein said discharge filter element further includes a frame molded over said filter material.

19. The vented hatch cover as claimed in claim 13 wherein said intake filter element includes a filter material.

20. The vented hatch cover as claimed in claim 19 wherein said filter material is a woven screen.

21. The vented hatch cover as claimed in claim 19 wherein said intake filter element further includes a frame molded over said filter material.

22. The vented hatch cover as claimed in claim 1 wherein said air intake passage is located radially outward of said pocket.

23. The vented hatch cover as claimed in claim 1 wherein said air intake passage is located below said gasket.

24. The vented hatch cover as claimed in claim 9 wherein said wall of said cover body defines a second air intake passage, a second air discharge passage and a second plenum extending from said second air intake passage to said second air discharge passage.

25. The vented hatch cover as claimed in claim 24 further comprises a second intake filter element disposed over said second air intake passage.

26. The vented hatch cover as claimed in claim 24 wherein said discharge filter element is disposed over said air discharge passage and said second air discharge passage.

27. A vented hatch cover comprising a cover body having a plurality of walls defining an air intake passage, an air discharge passage and a plenum extending from said air intake passage to said air discharge passage, said cover body includes a plurality of ribs extending across said air intake passage;

an intake filter element disposed over said air intake passage, said intake filter element includes a plurality of latches engaging said ribs to secure said intake filter element to said cover body;

wherein said intake filter element body is slidably secured to said cover body.

28. The vented hatch cover as claimed in claim 27 wherein each said latch includes a hook engaging one of said ribs to secure said intake filter element to said cover body.

29. The vented hatch cover as claimed in claim 27 wherein said intake filter element further includes a gap defined between adjacent latches, said gap has a width greater than the width of said ribs.

30. The vented hatch cover as claimed in claim 27 wherein each said latch defines a slot, each said rib situated in one of said slots to secure said intake filter element to said cover body.

31. The vented hatch cover as claimed in claim 27 wherein said intake filter element includes a plurality of cross beam portions, each of said cross beam portions is located immediately below one of said ribs upon said intake filter element secured to said cover body.

32. The vented hatch cover as claimed in claim 27 wherein said intake filter element includes a filter material located immediately below said air intake passage upon said intake filter element secured to said cover body.

33. The vented hatch cover as claimed in claim 32 wherein said intake filter element further includes a frame molded over said filter material.

34. The vented hatch cover as claimed in claim 27 further comprises a discharge filter element disposed over said air discharge passage.

35. The vented hatch cover as claimed in claim 27 further includes a gasket and wherein said cover body further includes an inner rim and an outer rim located radially outward of said inner rim, said inner rim and said outer rim defining a pocket, said gasket retained in said pocket.

36. The vented hatch cover as claimed in claim 35 wherein said cover body further includes a set of clips extending radially outward from said inner rim to retain said gasket to said cover body.

37. The vented hatch cover as claimed in claim 31 wherein said walls of said cover body further defines a second air intake passage, a second air discharge passage, and a second plenum extending from said second air intake passage to said second air discharge passage, and wherein said cover body further includes a plurality of ribs extending across said second air intake passage.

38. The vented hatch cover as claimed in claim 37 further comprises a second intake filter element disposed over said second air intake passage, said second intake filter element includes a plurality of latches engaging said ribs extending across said second air intake passage to secure said second intake filter element to said cover body.

39. The vented hatch cover as claimed in claim 38 wherein said second intake filter element includes a plurality of cross members, each said cross member of said second intake filter element is located immediately below one of said ribs extending across said second air intake passage upon said second intake filter element secured to said cover body.

40. The vented hatch cover as claimed in claim 37 wherein a discharge filter is disposed over said air discharge passage and said second air discharge passage.

* * * * *

UNITED STATES PATENT AND TRADEMARK OFFICE

CERTIFICATE OF CORRECTION

PATENT NO. : 7,703,630 B2
APPLICATION NO. : 11/610421
DATED : April 27, 2010
INVENTOR(S) : Alex V. Degutis et al.

It is certified that error appears in the above-identified patent and that said Letters Patent is hereby corrected as shown below:

Title Page, Item (73) Assignee:
Change "Saldo" to "Salco"

Signed and Sealed this

Twenty-second Day of June, 2010

David J. Kappos

David J. Kappos
*Director of the United States Patent and Trademark Office*